US009962053B2

(12) United States Patent
Seo et al.

(10) Patent No.: US 9,962,053 B2
(45) Date of Patent: May 8, 2018

(54) VACUUM CLEANER

(71) Applicant: LG ELECTRONICS INC., Seoul (KR)

(72) Inventors: Jinwook Seo, Changwon-si (KR); Jungmin Moon, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 17 days.

(21) Appl. No.: 14/951,729

(22) Filed: Nov. 25, 2015

(65) Prior Publication Data

US 2016/0073843 A1 Mar. 17, 2016

Related U.S. Application Data

(63) Continuation of application No. 13/019,377, filed on Feb. 2, 2011, now Pat. No. 9,265,392.

(60) Provisional application No. 61/301,208, filed on Feb. 4, 2010.

(51) Int. Cl.

| | |
|---|---|
| ***A47L 9/28*** | (2006.01) |
| ***A47L 9/10*** | (2006.01) |
| ***A47L 5/32*** | (2006.01) |
| ***A47L 9/26*** | (2006.01) |

(52) U.S. Cl.

CPC *A47L 9/26* (2013.01); *A47L 5/32* (2013.01); *A47L 9/2857* (2013.01)

(58) Field of Classification Search

CPC ..... A47L 9/26; A47L 5/32; A47L 9/23; A47L 9/2857; B65H 75/4423; B65H 75/4431; H02G 11/02; Y10S 15/10

See application file for complete search history.

(56) References Cited

U.S. PATENT DOCUMENTS

| | | | | |
|---|---|---|---|---|
| 1,887,173 | A | 11/1932 | Tamarin | |
| 2,261,074 | A | 10/1941 | Pinotti | |
| 2,474,566 | A * | 6/1949 | Applegate | H02G 11/02 242/390.8 |
| 2,633,596 | A | 4/1953 | Turner et al. | |
| 2,672,642 | A | 3/1954 | Tamarin et al. | |
| 2,937,396 | A | 5/1960 | Momberg et al. | |
| 3,339,030 | A * | 8/1967 | Nilsson | A47L 9/26 15/323 |
| 3,435,529 | A | 4/1969 | Quenot | |
| 3,606,977 | A | 9/1971 | Kakiuchi | |
| 3,993,309 | A | 11/1976 | Morris et al. | |
| 4,592,764 | A | 6/1986 | Ikezaki et al. | |

(Continued)

FOREIGN PATENT DOCUMENTS

| | | |
|---|---|---|
| DE | 4418867 A1 | 12/1995 |
| GB | 2083125 A | 3/1982 |

(Continued)

OTHER PUBLICATIONS

U.S. Office Action dated Nov. 7, 2013 issued in U.S. Appl. No. 13/019,377.

(Continued)

*Primary Examiner* — Christopher M Koehler
*Assistant Examiner* — Joel Crandall
(74) *Attorney, Agent, or Firm* — KED & Associates, LLP

(57) ABSTRACT

Provided is a vacuum cleaner. The vacuum cleaner includes a main body including a cord reel around which a power cord is wound and a cord reel button for operating the cord reel.

7 Claims, 7 Drawing Sheets

(56) References Cited

U.S. PATENT DOCUMENTS

| | | | | |
|---|---|---|---|---|
| 5,001,843 | A | 3/1991 | Chapin | |
| 5,023,410 | A | 6/1991 | Danielson et al. | |
| 5,168,598 | A | 12/1992 | Hashizume et al. | |
| 5,255,768 | A | 10/1993 | Kasper et al. | |
| 5,622,243 | A | 4/1997 | Kang | |
| 5,666,688 | A | 9/1997 | Kim | |
| 5,937,476 | A | 8/1999 | Kim | |
| 5,950,272 | A | 9/1999 | Kim et al. | |
| 6,502,775 | B1 | 1/2003 | Neufeld | |
| 6,502,778 | B2 | 1/2003 | Kim | |
| 7,273,192 | B2 | 9/2007 | Park | |
| 7,739,772 | B2 | 6/2010 | Park | |
| 2009/0144927 | A1* | 6/2009 | Yoo | A47L 5/225 15/300.1 |
| 2010/0269288 | A1* | 10/2010 | Yoo | A47L 5/28 15/347 |

FOREIGN PATENT DOCUMENTS

| | | | | |
|---|---|---|---|---|
| JP | 02-008157 | A | | 1/1990 |
| JP | 03-218721 | A | | 9/1991 |
| JP | 04-005944 | A | | 1/1992 |
| JP | 04-024012 | A | | 1/1992 |
| JP | 04-303375 | A | | 10/1992 |
| JP | 06-038911 | A | | 2/1994 |
| JP | 2001-157654 | A | | 6/2001 |
| JP | 2001157654 | A | * | 6/2001 |
| JP | 2002-017632 | A | | 1/2002 |
| JP | 2003-135340 | A | | 5/2003 |
| JP | 2005-230150 | A | | 9/2005 |
| JP | 2006-141597 | A | | 6/2006 |
| KR | 10-2009-0058923 | A | | 6/2009 |

OTHER PUBLICATIONS

U.S. Office Action dated Jun. 6, 2014 issued in U.S. Appl. No. 13/019,377.

U.S. Office Action dated Nov. 21, 2014 issued in U.S. Appl. No. 13/019,377.

U.S. Office Action dated Jun. 18, 2015 issued in U.S. Appl. No. 13/019,377.

Notice of Allowance dated Nov. 2, 2015 issued in U.S. Appl. No. 13/019,377.

* cited by examiner

VACUUM CLEANER

CROSS-REFERENCE TO RELATED APPLICATION(S)

The present application is a Continuation of U.S. patent application Ser. No. 13/019,377 filed on Feb. 2, 2011 (now U.S. Pat. No. 9,265,392), which claims priority to Provisional Application No. 61/301,208 filed Feb. 4, 2010.

BACKGROUND

1. Field

Embodiments relate to a vacuum cleaner.

2. Background

In general, vacuum cleaners are apparatuses, which suck air containing foreign substances such as dusts using a vacuum pressure generated by a motor mounted within a main body to filter the foreign substances in the main body.

Vacuum cleaners come into wide use in people's homes due to their convenience of use. Specifically, vacuum cleaners are increasingly in demand because of a need to clean felt carpets or sofas. The vacuum cleaners may be classified into a canister type vacuum cleaner in which a suction nozzle that is a suction hole is separated from a main body to connect the suction nozzle to the main body using an extension tube and an upright type vacuum cleaner in which a suction nozzle is integrated with a main body.

The upright type vacuum cleaner includes a main body in which a motor for generating a suction force is disposed, a suction nozzle for sucking air containing foreign substances from a floor by the suction force of the motor, and a dust collection unit for filtering the foreign substances from the sucked air. Also, a hook ring for winding and storing a power cord for applying a power the motor is disposed in the main body.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
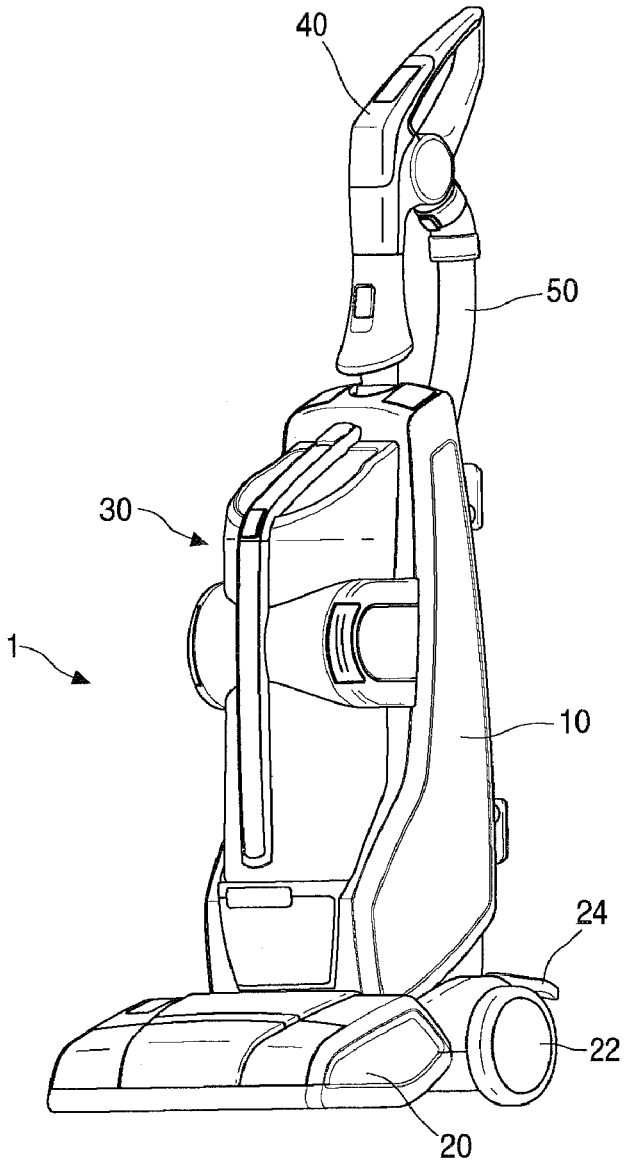
FIG. 1 is a perspective view of an upright type vacuum cleaner according to an embodiment.
Figure 2:
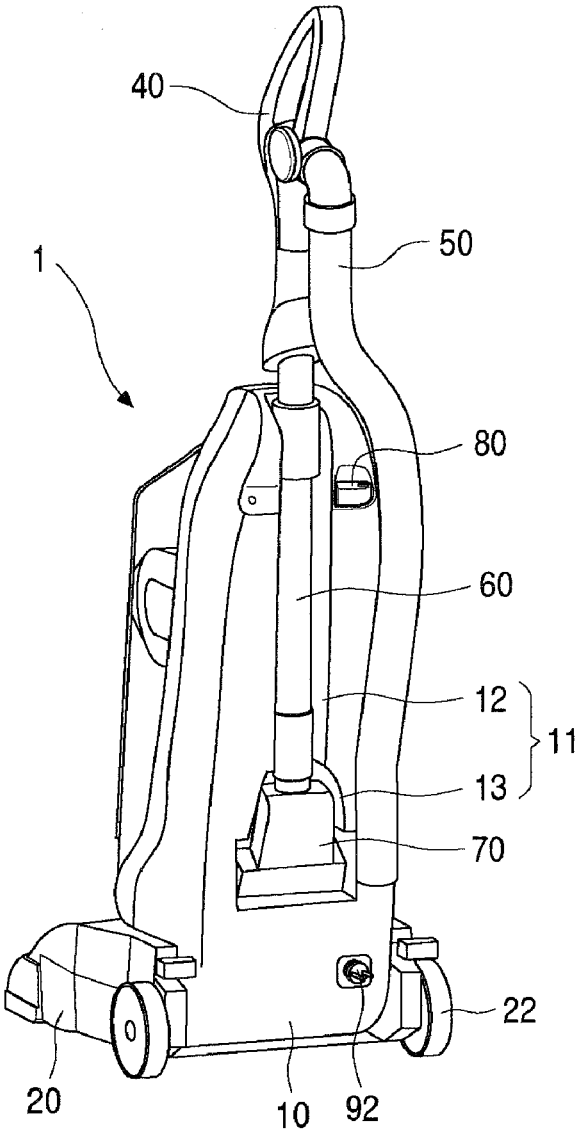
FIG. 2 is a rear perspective view of the upright type vacuum cleaner according to an embodiment.

FIG. 1 is a perspective view of an upright type vacuum cleaner according to an embodiment, and FIG. 2 is a rear perspective view of the upright type vacuum cleaner according to an embodiment.

Referring to FIGS. 1 and 2, a vacuum cleaner 1 according to an embodiment includes a main body 10 including a suction motor for generating a suction force, a first suction unit 20 rotatably connected to a lower portion of the main body 10 and placed on a floor, a dust separation unit 30 separably disposed on the main body 10, a second suction unit separably disposed on the main body 10 to clean the floor or portions except the floor, a handle disposed on an upper portion of the main body 10, and a connection hose 50 connecting the handle 40 to the main body 10.

In detail, a suction hole (not shown) for sucking dusts and air on the floor is defined in a bottom surface of the first suction unit 20. Wheels 22 for easily moving the first suction unit 20 are disposed on both sides of the first suction unit 20.

A manipulation part 24 is disposed at a rear side of the first suction unit 20 to allow the main body 10 to be rotated with the first suction unit 20 in a state where the main body 10 stands upright.

Thus, when the manipulation part 24 is operated, the main body 10 is rotated with respect to the first suction unit 20. Then, a user grasps the handle 40 to clean the floor while moving the first suction unit 20.

The dust separation unit 30 is selectively mounted on a front side of the main body 10, and the second suction unit is selectively mounted on a rear side of the main body 10. In general, the suction motor (not shown) is disposed on a lower portion of the inside of the main body 10, and the dust separation unit 30 is mounted on the main body 10 above the suction motor. The position of the suction motor may be easily confirmed through a plurality of published patent documents.

The dust separation unit 30 separates dusts from air sucked into the main body 10 to store the separated dusts.

The second suction unit includes a nozzle 70 for cleaning the floor or portions except the floor and a suction tube 60 connecting the nozzle 70 to the handle 40.

A recessed mounting part 11 on which the second suction unit is mounted is disposed in a back surface of the main body 10.

A suction tube mounting part 12 for mounting the suction tube 60 and a nozzle mounting part 13 for mounting the nozzle 70 are disposed on the mounting part 11. According to the current embodiment, since the nozzle 70 is mounted on the main body 10, it is unnecessary to separately store the nozzle 70.

Also, since the nozzle 70 is mounted on the main body 10 in a state where the nozzle 70 is connected to the suction tube 60, it is unnecessary to connect the nozzle 70 to the suction tube 60 so as to utilize the nozzle 70.

A passage (not shown) in which the dusts and air sucked through the nozzle 70 flow is disposed inside the handle 40. The connection hose 50 moves the dusts and air sucked through the nozzle 70 into the main body 10.

The connection hose 50 may be adjusted in length and formed of a movably flexible material.

An operation of the vacuum cleaner according to the current embodiment will be briefly described below.

Since a general upright vacuum cleaner should clean a floor while a suction unit connected to a lower portion of a main body is moved along the floor, it is difficult to clean places except the floor.

However, according to the current embodiment, the second suction unit may be separately coupled to the main body 10 to clean spaces except the floor.

When the second suction unit is separated from the main body 10, the floor or the portions except the floor may be cleaned using the second suction unit.

In detail, as shown in FIG. 1, for cleaning the floor, the main body 10 is rotated with the first suction unit 20 in a state where the second suction units 60 and 70 are coupled to the main body 10. Then, the user may clean the floor while moving the first suction unit 20 along the floor.

On the other hand, for cleaning the portions except the floor, the second suction units 60 and 70 are separated from the main body 10 in a state where the main body 10 stands upright to suck the air containing the dusts using the second suction units 60 and 70.

As described above, for selectively performing the cleaning using the first and second suction units, two passages in which air flows are provided in the main body 10. Also, one of the two passages selectively communicates with the suction motor.

A cord reel button 80 is disposed on an upper portion of the main body 10. In detail, a plug 92 connected to a power cord (see reference numeral 90 of FIG. 4) inserted into an electric outlet (not shown) disposed in a wall surface of a house to apply a power into the main body 10 is disposed at a lower portion of the back surface of the main body 10.

After the cleaning process is finished, the user pushes and operates the cord reel button 80. The cord reel button 80 operates a cord reel (see reference numeral 100 of FIG. 3) mounted inside the main body 10 to wind the power cord (see reference numeral 90 of FIG. 4) drawing out the main body 10 into the inside of the main body 10.

Figure 3:
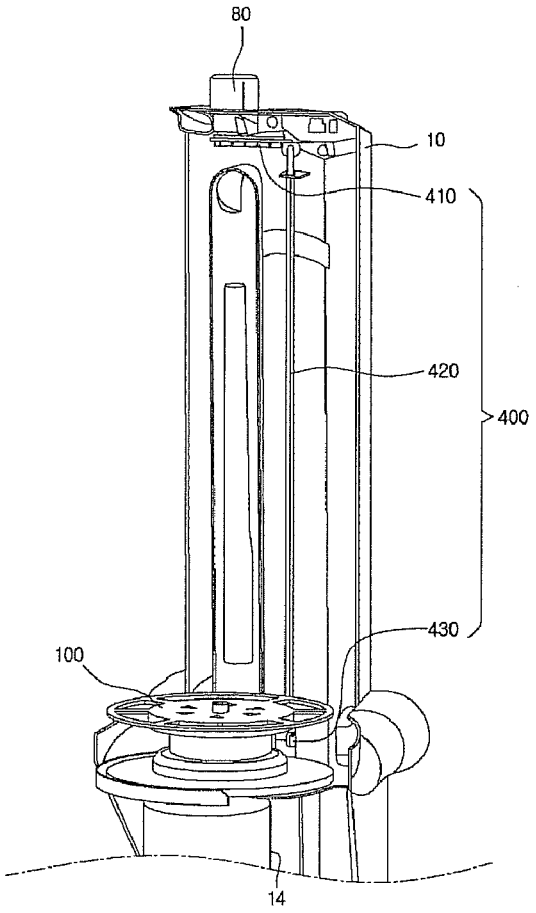
FIG. 3 is a perspective view of a power transmission member disposed in a main body of an upright type vacuum cleaner according to an embodiment.

FIG. 3 is a perspective view of a power transmission member disposed in a main body of an upright type vacuum cleaner according to an embodiment.

Referring to FIG. 3, as described above, the cord reel button 80 is disposed on an upper portion of the main body 10. Also, a power transmission member 400 for transmitting an operation force of the cord reel button 80 into the cord reel 100 is disposed in the main body 10.

The power transmission member 400 includes a first power transmission member 410 vertically rotated to transmit the power downward, a connection part 420 for transmitting a power from the first power transmission member 410 to a second power transmission member 430 (that will be described later) and the second power transmission member 430 for transmitting the power transmitted from the connection part 420 to the cord reel 100.

The cord reel 100 may be disposed above the suction motor (not shown) disposed inside the main body 10. When the dust separation unit is mounted on the main body, the dust separation unit may be disposed above the cord reel 100.

When the cord reel button 80 is operated, the cord reel is operated by the power transmitted through the power transmission member 400 to wind the power cord.

Figure 4:
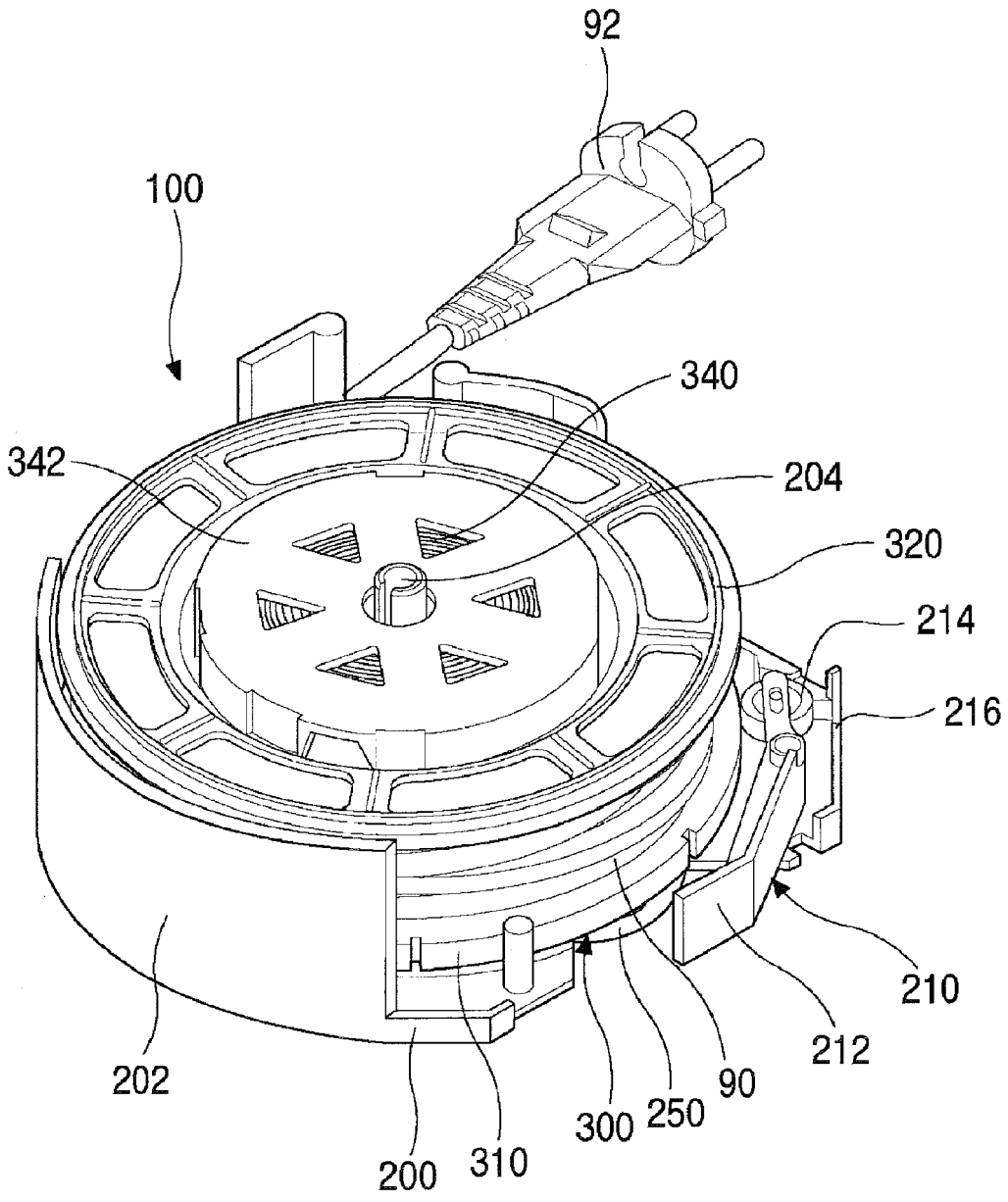
FIG. 4 is a perspective view illustrating an outer appearance of a cord reel disposed in a main body of an upright type vacuum cleaner according to an embodiment.

FIG. 4 is a perspective view illustrating an outer appearance of a cord reel disposed in a main body of an upright type vacuum cleaner according to an embodiment.

Referring to FIG. 4, the cord reel 100 according to an embodiment includes a base frame 200 and a reel member 300 rotatably supported with respect to a rotation shaft 204 on the base frame 200.

The power cord 90 is wound around the reel member, and the plug 92 inserted into the electric outlet disposed on the wall surface is disposed on an end of the power cord 90.

In detail, the reel member 300 includes a lower reel member 310 disposed above the base frame 200, and an upper reel member 320 disposed parallel to the base frame 200 and the lower reel member 310 and spaced a predetermined distance from the lower reel member 310, and a spool (not shown) disposed between the upper and lower reel members 310 and 310 to wind and store the power cord 90 there around.

Also, a spring 340 having a predetermined elastic force is disposed above the upper reel member 320. Since the spring 340 elastically supports the reel member 300 in one direction, the reel member 300 may be rotated when the reel member 300 is spaced from a break unit 210.

That is, since the reel member 300 is rotated with respect to the rotation shaft 204 by the spring 340, the power cord 90 may be wound around the spool (not shown).

A spring housing 342 having a shape corresponding to an outer appearance of the spring 340 and receiving the spring 340 therein is disposed above the spring 340. Thus, it may prevent the spring 340 from being separated due to the spring housing 342.

Also, the rotation shaft 204 protruding upward is disposed at a center of the base frame 200. The rotation shaft 240 passes through centers of the lower reel member 310, the spool (not shown), and the upper reel member 320. Thus, the reel member 300 may be rotatably supported with respect to the rotation shaft 204, and the power cord 90 may be wound by the operation of the reel member 300.

The rotation shaft 204 of the cord reel 100 vertically extends in a state where the cord reel 100 is mounted on the main body 10.

The break unit 210 is disposed on the base frame 200. In detail, the break unit 210 includes a release lever 212, a break drum 214 disposed on an end of the release lever 212 to control the rotation of the lower reel member 310, and a torsion spring 216 for elastically supporting the break drum 214 toward the lower reel member 310.

Thus, when a force pulling the power cord 90 is removed in a state where the user pulls the power cord 90 to connect the plug 92 to the electric outlet, the break drum 214 is closely attached to the lower reel member 310. Thus, a predetermined breaking force is applied to the lower reel member 310 to restrict the rotation of the lower reel member 310.

On the other hand, when the release lever 212 is pushed, the break drum 214 closely attached to the lower reel member 310 is spaced from the lower reel member 310. Thus, since the reel member 300 is rotated by an elastic restoring force of the spring 340, the power cord 90 is wound around the reel member 300.

Figure 5:
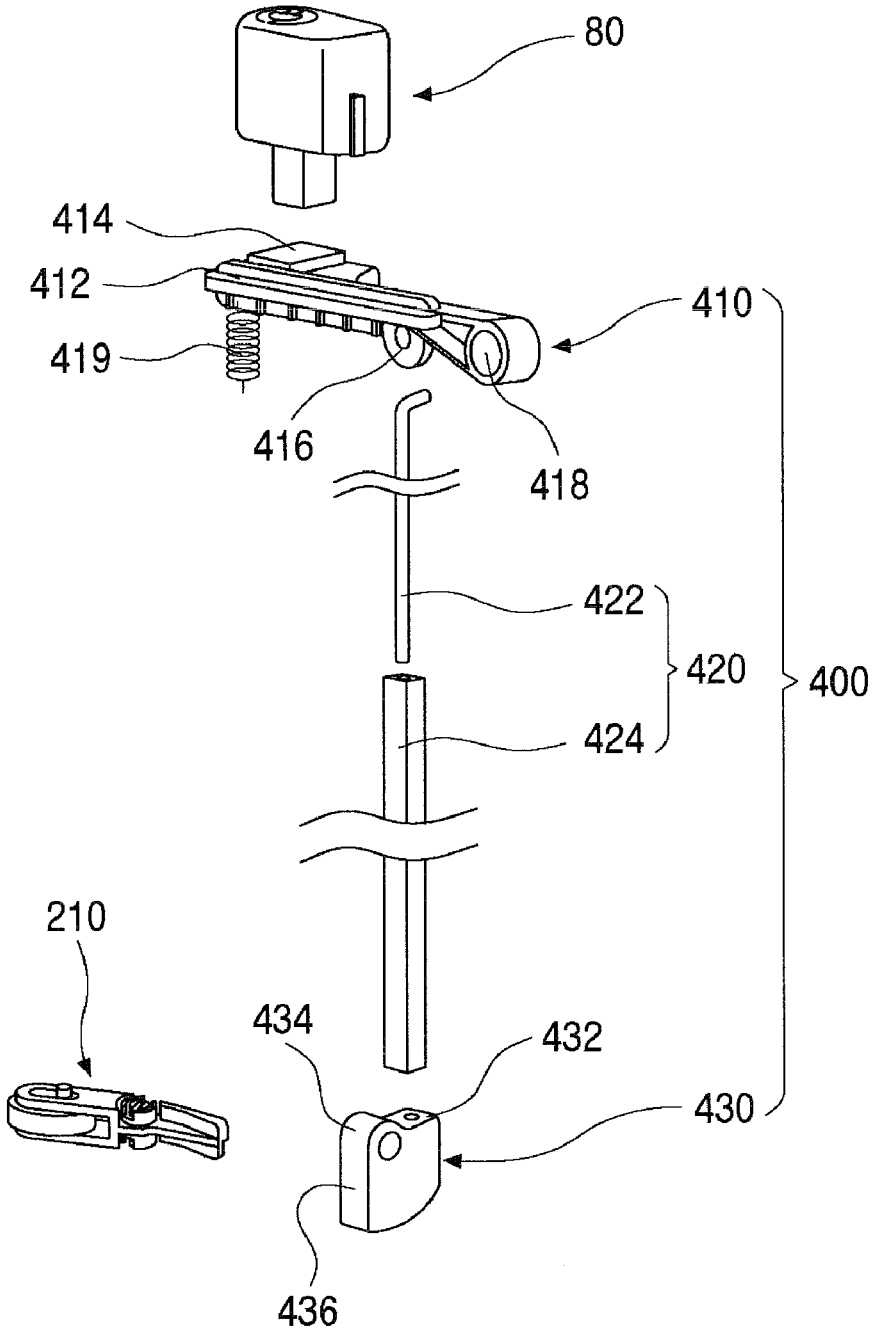
FIG. 5 is an exploded perspective view of a power transmission member according to an embodiment.

FIG. 5 is an exploded perspective view of a power transmission member according to an embodiment.

Referring to FIGS. 3 and 5, the power transmission member 400 includes the first power transmission member 410 for downwardly transmitting the force applied by the cord reel button through a lever-action, the connection part 420 for directly downwardly transmitting the force transmitted from the first power transmission member 410, and the second transmission member 430 for transmitting the force transmitted through the connection part 420 to the break unit 210 of the cord reel 100.

In detail, the first power transmission member 410 has a bar shape which is rotated by using an end thereof as a rotation axis. The first power transmission member 410 includes a main body 412 having a bar shape, a rotation shaft 418 disposed on an end of the main body 412 to serve as a center of the rotation movement of the main body 412, a push part 414 contacting the cord reel button 80 to transmit the force applied by the cord reel button 80, an elastic member 419 for elastically supporting the push part 414, and a transmission part 416 for transmitting the applied force downward.

The push part 414 is vertically rotated with respect to the rotation shaft 418 in a state where it 414 surface-contacts the cord reel button 80.

The push part 414 has a shape corresponding to that of section of a lower end of the cord reel button 80. In the current embodiment, the push part 414 may have a square plate shape.

The transmission part 416 transmits the force transmitted through the push part 414 to the connection part 420. In the current embodiment, the transmission part 416 is disposed between the push part 414 and the rotation shaft 418. The transmission part 416 has a circular plate shape with a hollow so that it is coupled to the connection part 420.

The transmission part 416 transmits the power downward through a lever-action principle using a difference of a rotation moment depending on a distance ratio between the push part 414 and the transmission part 416.

The connection part 420 is coupled to the transmission part 416. The connection part 420 includes a shaft 422 directly coupled to the transmission part 416 and a cover 424 surrounding an outer surface of the shaft 422.

The shaft 422 may be a rod having a predetermined length and formed of an iron material. The shaft 422 has one end coupled to the transmission part 416 and the other end coupled to the second power transmission member 430.

The cover 424 surrounds the outer surface of the shaft 424 to protect the shaft 424. That is, the cover 424 may prevent the shaft 424 from rusting by moisture and also prevent the shaft 424 from being damaged by an external force.

The second power transmission member 430 is connected to the other end of the connection part 420. The second power transmission part 430 includes a push part 432 receiving a power from the connection part 420, a rotation shaft 434 serving as a rotation center, and a contact part 436 surface-contacting the break unit 210 to transmit the force transmitted through the push part 432 to the break unit 210.

According to an embodiment, the second power transmission member 430 has an approximately predetermined thickness and a sectional area corresponding to that of a quarter of a circle.

The second power transmission member 430 has one surface serving as the push part 432 and the other surface serving as the contact part 436. The rotation shaft 434 may coupled to the main body 10.

Thus, when the connection part 420 presses the push part 432 and is rotated with respect to the rotation shaft 434, the contact part 436 presses the release lever 212 to operate the cord reel 100.

Figure 6:
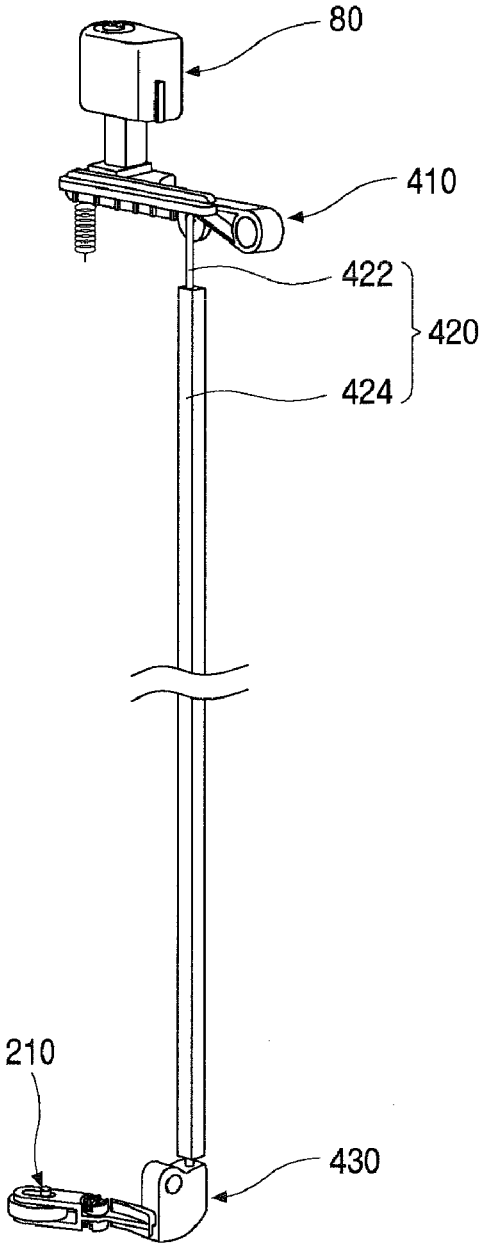
FIG. 6 is a perspective view illustrating an operation structure of a cord reel in a state where a cord reel button is not pushed.
Figure 7:
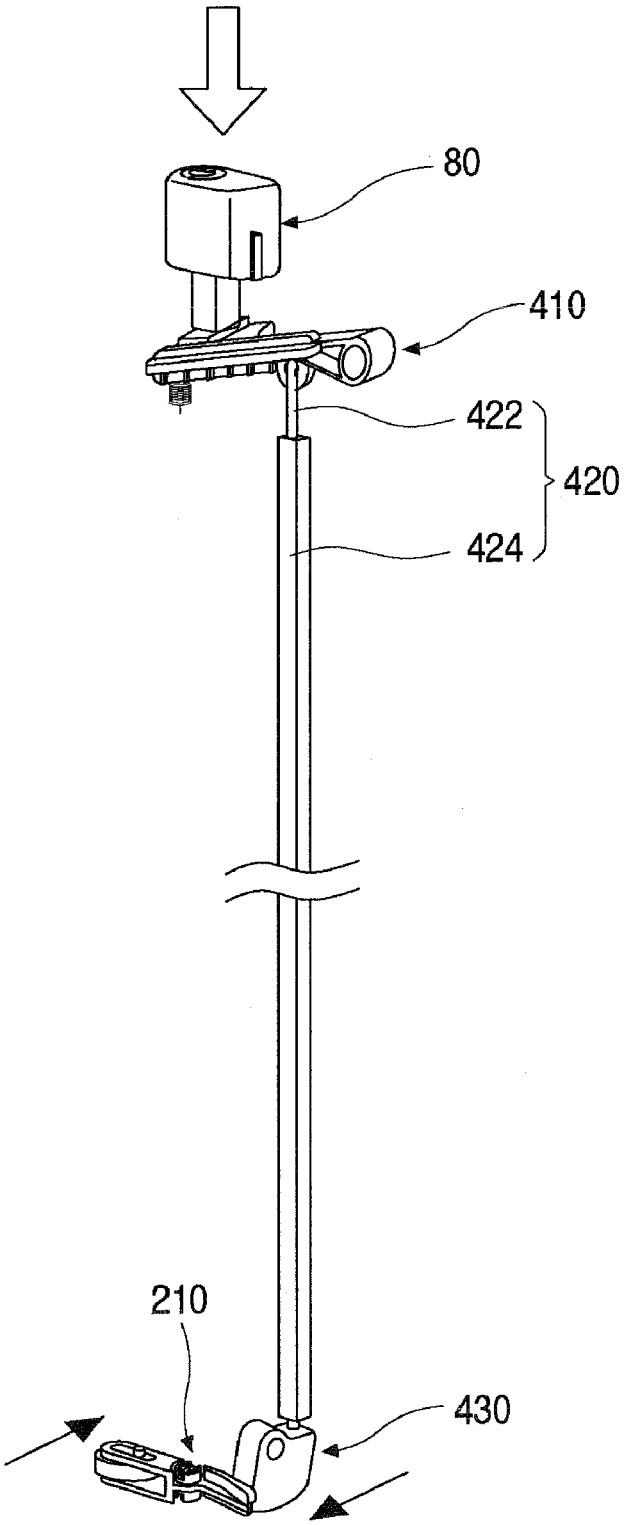
FIG. 7 is a perspective view illustrating an operation structure of a cord reel in a state where a cord reel button is pushed.

FIG. 6 is a perspective view illustrating an operation structure of a cord reel in a state where a cord reel button is not pushed, and FIG. 7 is a perspective view illustrating an operation structure of a cord reel in a state where a cord reel button is pushed.

Referring to FIGS. 4 to 7, when the user grasps the plug 92 and pulls the plug 92 out of the cleaner to connect the plug 92 to the electric outlet, the power cord 90 is taken from the inside of the cord reel 100.

When the power cord 90 is arranged after the cleaning process is finished, the user pushes the cord reel button 80 disposed on a top end of the main body 10. Thus, the cord reel button 80 presses the push part 414 of the first power transmission member 410 to rotate the first power transmission member 410 downward with respect to the rotation shaft 418 by a predetermined angle.

Here, the connection part 420 to which the one end thereof is connected to the transmission part 416 is vertically moved downward.

The connection part 420 presses the push part 432 of the second power transmission member 430. The second power transmission member 430 is rotated with respect to the rotation shaft 434 by a predetermined angle.

Then, the contact part 436 presses the release lever 212 of the break unit 210. As a result, the reel member 300 is rotated by the restoring force of the spring 340 in a direction in which the power cord is wound. Then, the power cord 90 is wound within the reel member 300 by the rotation of the reel member 300.

According to the foregoing embodiment, since the cord reel 100 is disposed in the main body 10, it may be unnecessary that the user directly winds the power cord 90. In addition, since the cord reel 100 is disposed under the dust separation unit and the cord reel button 80 for manipulating the winding of the power cord 90 is disposed on the upper portion of the main body 10, it may be unnecessary that the user bows down to manipulate the cord reel button 80.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vacuum cleaner comprising:

a suction nozzle;

a main body communicated with the suction nozzle, the main body housing a suction motor to generate a suction force and rotatably connected to the suction nozzle;

a dust separation device to separate dust from air sucked into the main body and to store the dust, mounted on the main body;

a cord reel provided in the main body, wherein the cord reel is provided between the suction motor and the dust separation device and is configured to receive a power cord that supplies power to the vacuum cleaner wound therearound, a cord reel button provided on the main body, wherein the cord reel is configured to receive a manipulation force to wind the power cord around the cord reel; and a power transmission member to transmit the manipulation force from the cord reel button to the cord reel, wherein the power transmission member includes:

a first power transmission member configured to move in response to the manipulation force provided at the cord reel button;

a connection part moved in response to the rotation of the first power transmission member; and a second power transmission member that receives power transmitted from the connection part and transmits the received power to the cord reel, wherein the cord reel rotates about a first axis of rotation in a state in which the main body is oriented vertically, the axis of rotation of the cord reel passing through the suction motor and the dust separation device, and the connection part is moved in the first direction, wherein the first power transmission member rotates about a second axis of rotation different from the first axis of rotation, and wherein the second power transmission member rotates about a third axis of rotation different from the first and second axes of rotation.

2. The vacuum cleaner according to claim 1, wherein the cord reel button is provided above the cord reel at the main body.

3. The vacuum cleaner according to claim 1, wherein the cord reel is provided above the suction motor and under the dust separation device.

4. The vacuum cleaner according to claim 3, wherein the cord reel button is provided above the suction motor.

5. The vacuum cleaner according to claim 1, wherein the connection part includes a shaft that connects the first power transmission member to the second power transmission member and a cover that covers the shaft to protect the shaft.

6. The vacuum cleaner according to claim 1, further including an elastic member that elastically supports the first power transmission member.

7. The vacuum cleaner according to claim 1, wherein the dust separation device is detachably mounted to a front side of the main body and the cord reel button is provided on a rear side of the main body.

* * * * *